United States Patent [19]

Beretta

[11] 4,265,161

[45] May 5, 1981

[54] MEANS FOR CONTROLLING RAPID-FIRE IN AN AUTOMATIC WEAPON

[75] Inventor: Pier C. Beretta, Gardone Val Trompia, Italy

[73] Assignee: Fabbrica D'Armi Pietro Beretta S.p.A., Gardone V.T., Italy

[21] Appl. No.: 10,144

[22] Filed: Feb. 7, 1979

[30] Foreign Application Priority Data

Feb. 7, 1978 [IT] Italy ..... 5122 A/78

[51] Int. Cl.[3] ..... F41D 11/10

[52] U.S. Cl. ..... 89/129 B

[58] Field of Search ..... 89/129 B

[56] References Cited

FOREIGN PATENT DOCUMENTS 1297002 6/1969 Fed. Rep. of Germany ..... 89/129 B

*Primary Examiner*—Stephen C. Bentley

[57] ABSTRACT

The present invention provides a conventional weapon with means that permit selective firing in a single shot mode, an automatic mode or in a mode wherein a predetermined number of shots are sequentially fired while the trigger is kept in the squeezed condition. A selector lever is employed for determining which mode of operation is employed.

8 Claims, 7 Drawing Figures

MEANS FOR CONTROLLING RAPID-FIRE IN AN AUTOMATIC WEAPON

BACKGROUND OF THE INVENTION

1. Field of the Invention

The present invention relates, in general, to improvements in automatic firearms, pistols or rifles, and more particularly to means for controlled, rapid-fire of automatic weapons.

2. Description of the Prior Art

It is already known to use devices which allow a semi-automatic fire, that is a multiplicity of individual shots issued by releasing the trigger after each individual shot. Devices are also known for automatic rapid-fire, which is achieved by maintaining the trigger in a squeezed position. In this case, the weapon automatically and continuously repeats the cycle of arming, loading and firing, until all of the available shells or cartridges in the magazine are exhausted. It is nevertheless impossible to have adequate control of the rapid-firing by means of the trigger, because great diversity and variation in the number of cartridges utilized will result with different pressures applied to the trigger.

SUMMARY OF THE INVENTION

It is, therefore, an object of the present invention to provide means which, besides permitting either single or automatic firing as in conventional weapons, also allows a controlled, automatic (rapid) fire, i.e. the sequential firing of a pre-established number of shots, while the trigger is kept in the squeezed position.

It is another object of the present invention to provide means which is readily applicable to and detachable from (as a unit) conventional weapons, without altering the essential structure of these firearms.

It is a further object of the invention to provide means for controlling the automatic (rapid) fire of a weapon, which means is activated and deactivated by means of a selector lever, so that the weapon might be selectively employed with three different firing modes, that is single shots, automatic fire and a pre-determined quantity of automatic fire.

These and other objects of the invention are achieved by the means described hereinafter in greater detail, which means briefly stated comprises: a trigger; a hammer capable of angular displacements toward and away from the firing pin and having thereon a pair of arming teeth angularly spaced from each other; a trip lever associated with one of said arming teeth and capable of angular displacements; a pull-rod attached to the trigger and arranged to act upon the trip lever for the detachment of the hammer; a rapid-fire lever associated with the other of said arming teeth during the phases of automatic firing; a striker member which moves axially and carries the firing pin, the striker member being provided with cams that engage, in a known and conventional manner, the pull-rod and the rapid-fire lever. The present invention further comprises means for transferring the displacements of the striker from the striker itself to the arming pull-rod; a selector lever for the controlled automatic fire, which lever is capable of angular displacements and is provided with suitable cams; a disengagement rocker lever arm pivotably associated with said transfer means and capable of being moved into active or inactive position by the cams of the selector lever, the disengagement rocker lever arm being further provided with a counting tooth for a controlled sequence of shots; and a rod for controlling the automatic firing, the control rod being connected to the pull-rod while concurrently being moved to either linear or angular displacements depending on the movements of the pull-rod, said control rod being further provided with a first group of teeth or notches for engaging the counting tooth, and with a second group of teeth or notches associated with a spring-loaded pawl which is connected to the control rod, each group of teeth having a number of teeth corresponding to the number of shots to be sequentially fired during the controlled automatic use of the weapon.

BRIEF DESCRIPTION OF THE DRAWING

The invention will become clearer and more apparent from the following detailed description thereof and from the accompanying drawings which illustratively represent an automatic pistol with means for rapid-firing a sequence of three shots. It is to be clearly understood that the weapon could equally be a rifle and that the number of sequentially issued (or fired) shots may vary.

In the accompanying drawings.

DESCRIPTION OF THE PREFERRED EMBODIMENT

Figure 4:
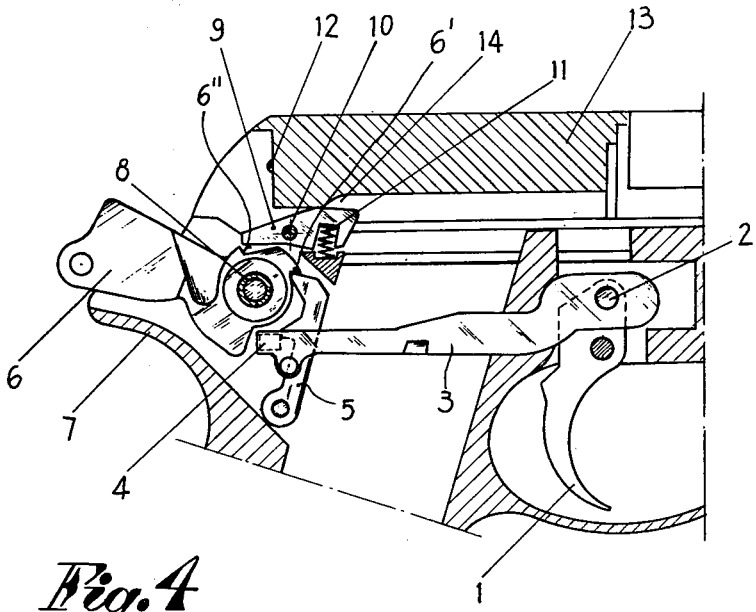
FIG. 4 is another view similar to FIGS. 2 and 3 illustrating one embodiment for connecting the trigger to the trip lever of the hammer and to the arming lever for automatic firing, which latter lever is actuated by the striker.

Referring now to FIG. 4 of the accompanying drawings, to trigger 1 of the weapon there is connected, by means of a pivot pin 2, one extremity of an arming pull-rod 3, the opposite extremity of which is provided with a projection 4 which faces toward and is associated with a trip lever 5 that serves to engage and disengage the hammer 6 of the weapon by means of a hollow transverse pin 8 and is provided with a first arming tooth 6', which engages the trip lever 5, and with a second arming tooth 6'', which engages a rapid-fire lever 9. The rapid-fire lever 9 is pivoted on a pin 10 that is also mounted on the body 7. The trip lever 5 is urged by a spring (not shown), which spring always keeps the trip lever 5 displaced toward the hammer 6, so as to engage the respective arming tooth 6'. The rapid-fire lever 9 is equally urged by a spring 11, which keeps the rapid-fire lever 9 normally rotated toward the second arming tooth 6″ of the hammer 6, so as to engage therewith when the hammer 6 is first armed and then released and, thus, caused to strike against a firing pin 12 mounted within a striker carriage 13 which is guided and moved axially along the body 7 of the weapon. The striker carriage 13 is provided with a first cam surface 14 which acts upon the rapid-fire lever 9 in a direction opposed to that of the spring 11, so as to automatically disengage the rapid-fire lever 9 from the second tooth 6″ of the hammer when the striker carriage 13, after each recoiling, returns to its closed position. The striker carriage 13 is also provided with a second cam surface 15 (FIG. 2) positioned above the arming pullrod 3 and acting thereon by means of an intermediate transfer lever 16, which serves to angularly displace the arming pull-rod 3, about the pivot pin 2, in a direction opposite to that of a spring 17 so that the action of the arming pull-rod 3 upon the trip lever 5 is neutralized, while at the same time the spring 17, which is generally U-shaped, tends to maintain the arming pull-rod 3 coupled in an active position with the trip lever 5.

According to the invention, the transfer lever 16 is pivoted about the transverse pin 8, similarly to the hammer 6, and is urged by a torsion spring 18 which maintains the lever 16 displaced upwardly toward the striker carriage 13. The transfer lever 16 is provided on its upper surface or rim with a cam follower 19 (FIG. 2) which corresponds to and is associated with the cam surface 15 of the striker carriage 13. In other words, while the cam surface 15 has a rabbet-like or groove-like configuration, the corresponding cam 19 has a relief-like or protruding configuration, so that the cam 19 is seated within the cam surface 15 when the striker carriage 13 is in position to have the weapon closed, to this position corresponding the possibility of the pull-rod 3 acting on the trip lever 5 for the disengagement of the hammer 6, through the trigger 1.

Figure 1:
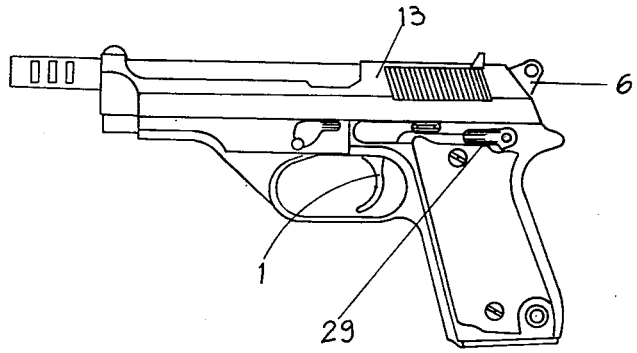
FIG. 1 is a side elevational view of a pistol comprising the present invention.
Figure 2:
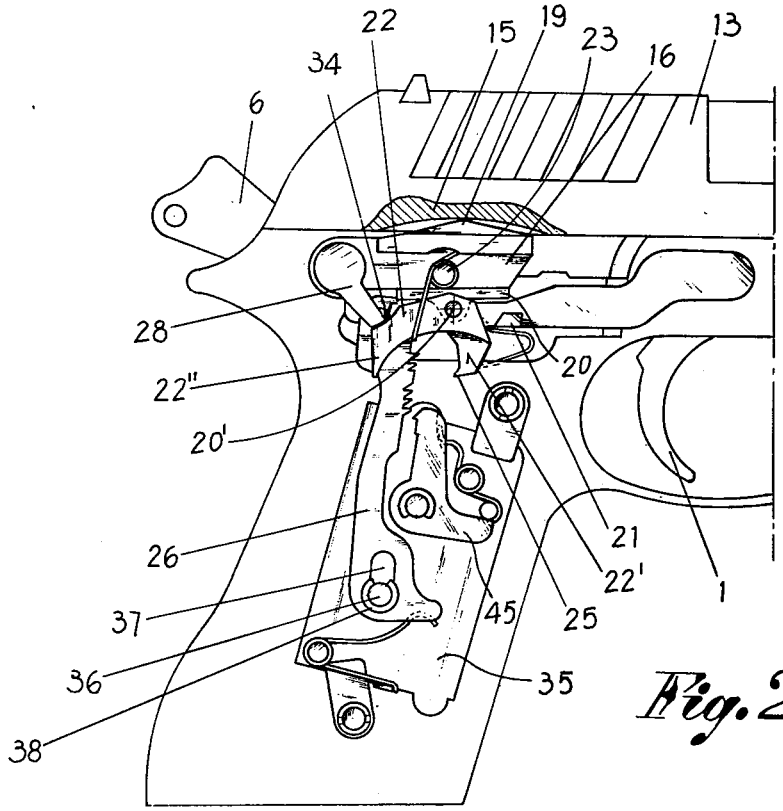
FIG. 2 is a fragmentary, side elevational view partially broken away and partially in section illustrating the rapid fire control means of this invention in its inactive position, so that the weapon may be employed in its conventional manner.

With the lower surface or rim of the transfer lever 16 there is associated, as shown in FIG. 2, a small mobile rod 20 which causes the transfer lever 16 to act upon a projection 21 provided in an intermediate part of the pull-rod 3 for the purpose of displacing the pull-rod 3 downwardly whenever the transfer lever 16 is acted upon by the striker carriage 13 during the recoiling phase, i.e. after each shot. This downward displacement of the arming pull-rod 3 permits the arresting of the hammer 6 in the armed position, by the trip lever 5, only during the phases of semi-automatic firing of the weapon and at the conclusion of the controlled automatic firing, as explained more fully hereinbelow.

Figure 3:
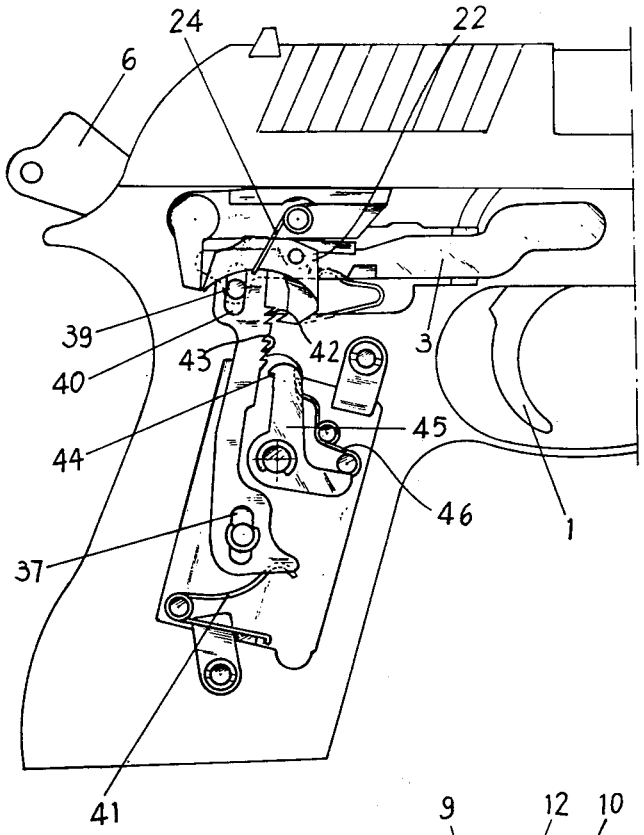
FIG. 3 is a view similar to FIG. 2 illustrating the rapid-fire control means of this invention in its active position.
Figure 7:
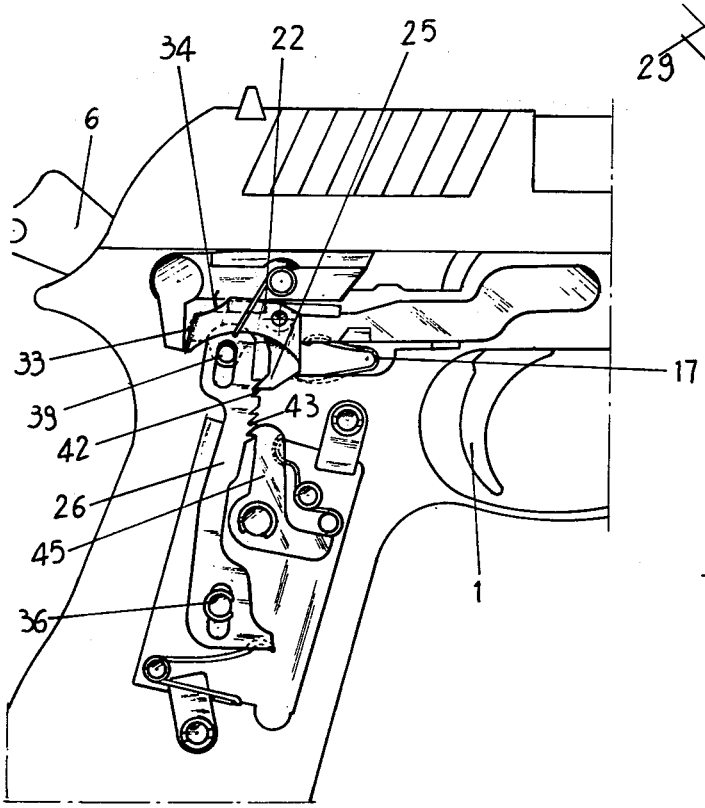
FIG. 7 is another view similar to FIGS. 2, 3 and 4 illustrating the rapid-fire control means in an intermediate phase of the firing sequence of the predetermined number of shots.

The small mobile rod 20 is pivoted at 20′ on a disengagement rocker lever arm 22, so as to move together therewith without acting upon the projection 21 of the arming pull-rod 3 when the disengager 22 is in the active position to allow the controlled automatic, rapid-fire. The disengager rocker lever arm 22 is pivoted, through a pin 23, on the transfer lever 16, so as to be displaceable either together therewith in a vertical direction (up and down), or independently thereof in a pendular sense about its own pivot pin 23. To be more precise, the disengager rocker lever arm 22 is provided with a leg 22′ directed downwardly and having a tooth 25 for counting the number of shots fired. This counting tooth 25 is associated with a rapid-fired control rod 26 as shown in FIGS. 2, 3 and 7 and as more fully described hereinbelow. The disengager rocker lever 22 is further provided with a second leg 22″ directed rearwardly and engaged by a fire selector means which acts in a direction against a torsion spring 24. The spring 24 tends to keep the disengager rocker lever arm 22 displaced rearwardly and in an active position, that is to say, with its own counting tooth 25 near the rapid-fired control rod 26.

Figure 5:
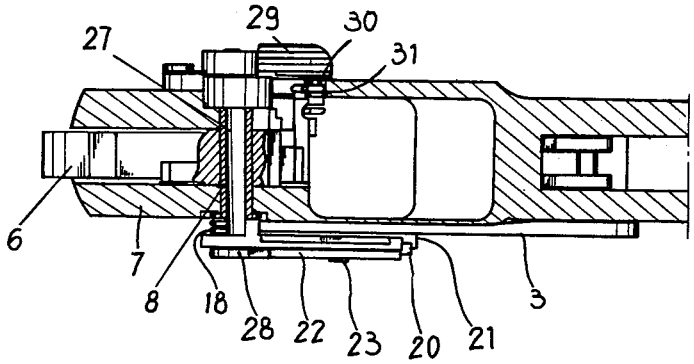
FIG. 5 is a fragmentary sectional plan view of the selector lever for positioning the device that controls the automatic fire of the weapon.
Figure 6:
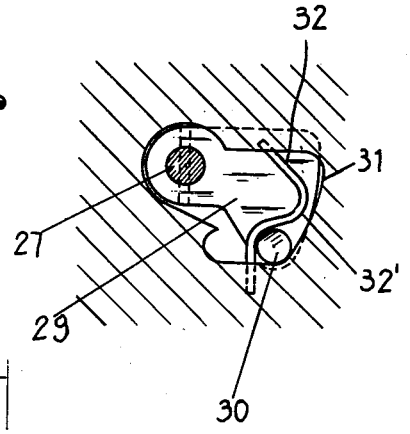
FIG. 6 is a detailed elevational view of the selector lever and of its positioning spring members.

The fire selector means referred to above and illustrated in FIGS. 2, 5 and 6 of the accompanying drawings comprises a shaft 27 mounted through the hollow transverse pin 8 which serves as a pivot for the hammer 6; a cam plate 28 pivotally attached to one extremity of the shaft 27 for engagement against the leg 22″ of the disengager rocker lever arm 22 and for positioning and arresting the latter in an inactive position with respect to the rapidfire control lever 26; and a lever 29 attached to the opposed extremity of the shaft 27, the lever 29 being therefore positioned on the side of the weapon which is opposite to the side on which the disengager rocker lever arm 22 is mounted.

The lever 29 of the fire selector means has a pin 30 facing toward the center and in juxtaposition with a cut 31 in the body 7 of the weapon, and associated with a spring 32 that has an intermediate bend 32′ and which serves, together with the cut 31, to define two portions for arresting the lever 29, to which lever 29 correspond the active and inactive positions of the disengager rocker lever arm 22.

The leg 22″ of the disengager rocker lever arm 22 is, in turn, provided at its free extremity with a surface 33 against which the cam plate 28 of the fire selector means 27, 28 and 29 acts. As a continuation of the surface 33, there is a seat 34 within which is seated the cam plate 28 to insure the arrest of the disengager rocker lever arm 22 in its inactive position, as illustrated in FIG. 2.

As mentioned above, the disengager rocker lever arm 22 is associated with the rapid-fire control rod 26, which, in turn, is preferably associated with a support plate 35 that is removably attached to the side of the handle of the weapon where the pull-rod 3 and the transfer lever 16 are located.

The rapid-fire control rod 26 can be displaced either longitudinally in a vertical direction or angularly about a fulcrum formed by a transverse pin 36 fixed to the support plate 35 and extending within an elongated slot 37 provided in the lower part of the rapid-fire control rod 26 which is movably attached to the pin 36, for instance by means of a resilient retaining ring 38. Proximate its upper end, the rapid-fire control rod 26 is attached to the arming pull-rod 3 by means of a pin 39 that is integral with the pull-rod 3 and which is seated within a slot 40 provided in the rapid-fire control rod 26. In this manner the linear displacements of the pull-rod 3, effected in a known manner by the trigger 1, correspond to the angular displacements of the rapid-fire control rod 26 with a fulcrum at the pin 36. On the other hand, however, the rapid-fire control rod 26 is also displaceable vertically by the action of the disengager rocker lever arm 22, which tends to move the rapid-fire control rod 26 downwardly, and by action of a torsion-like recovery spring 41 which, acting on the base of the rapid-fire control rod 26, tends to move the rapid-fire control rod 26 upwardly. These displacements are permitted by the elongated slots 37 and 40 within which are guided the pin 36 and the pin 39 of the arming pull-rod 3.

On that surface of the rapid-fire control rod 26 which faces the counting tooth 25 of the disengager rocker lever arm 22, there is provided a first upper group of two or more teeth or notches 42 (three are shown in the drawings) with which the counting tooth 25 of the disengager rocker lever arm 22 sequentially engages when the disengager rocker lever arm 22 is in anactive position. On the rapid-fire control rod 26 there is further provided a second, lower group of an equal number of teeth or notches 43 with which the projection 44 of an arrest lever 45 comes into engagement. The arrest lever 45 is associated with the rapid-fire control rod 26 and is urged by a torsion spring 46 which keeps the arrest lever near the rapid-fire control rod 26, so that the arrest lever 45 blocks the rapid-fire control rod 26 as the rapid-fire control rod 26 is displaced downwardly by the counting tooth 25. The arrest lever 45 may be associated with means (not shown) for spacing it from rapid-fire control rod 26, if so desired, so as to eliminate its arresting action of the rapid-fire control rod 26.

When the disengager rocker lever arm 22 is displaced, by means of the fire selector components 27, 28 and 29, to the inactive position, illustrated in FIG. 2 of the drawings, and the action of the arresting lever 45 is thus annulled, then the weapon may be employed in its conventional and traditional sense to effect single shooting or semi-automatic firing (i.e. a plurality of separate, individual shots), the trigger 1 being released after each shot.

In semi-automatic firing, the arming pull-rod 3 effects the displacement of the trip lever 5 for the engagement of the hammer 6 previously armed. By releasing the trigger 1 after the shot is fired, the hammer 6 is armed by the trip lever 5 by virtue of the recoiling of the striker carriage 13. The striker carriage 13, in fact, besides displacing the hammer 6, displaces downwardly, by means of the cam surface 15, the transfer lever 16 which, in turn, via the small mobile rod 20 associated therewith, acts on the intermediate projection 21 of the arming pull-rod 3, moving the arming pull-rod 3 downwardly, so as to allow the trip lever 5 to move and engage the tooth 6' of the armed hammer 6. With the recoiling of the striker carriage 13, the rapid-fire lever 9, freed from its cam surface 14, is also displaced and engages against the respective tooth 6'' of the hammer 6. However, when the striker carriage 13 returns to its closing position, the cam surface 14 voids the engagement of rapid-fire lever 9, so that the hammer 6 remains engaged only with the trip lever 5. In this case, the hammer 6 can be disengaged by again displacing the trigger 1.

For automatic rapid-fire, without control, it is necessary to move, by means of the fire selector means 27, 28 and 29, the disengager rocker lever arm 22 in the active position (FIG. 2) and cancel the action of the arrest lever 45 on the rapid-fire control rod 26. In this case, by keeping the trigger 1 in the squeezed condition, after the first shot, the trip lever 5 is maintained continually spaced from hammer 6 by means of the pull-rod 3, so that, by virtue of the recoiling action of the striker carriage 13, the engagement of the hammer 6, in the armed position, is obtained solely through the rapid-fire lever 9. The subsequent advance of the striker carriage 13 to close the weapon determines however, via cam surface 14, the displacement of the rapid-fire lever 9 in the sense of freeing the hammer 6 which thus immediately effects the firing action for the release of another bullet. This sequence is continued as long as the trigger 1 is kept in the squeezed position and as long as there are shells in the magazine.

For controlled rapid fire it is instead necessary to activate the arrest lever 45 and to displace, by means of the fire selector means 27, 28 and 29, the disengager rocker lever arm 22 into its active position (FIG. 3). To this displacement corresponds, on one hand, the approaching of the counting tooth 25 to its respective group of teeth or notches 42 of the rapid-fire control lever 26 and, on the other hand, the removal of small mobile rod 20, which is associated with the transfer lever 16, from the intermediate projection 21 of the arming pull-rod 3. In this manner, the angular displacements of the transver lever 16 which are derived from the recoiling and closing action of the striker carriage 13 have no effect upon the arming pull-rod 3, but do affect the rapid-fire control rod 26, via the counting tooth 25. The rapid-fire control rod 26 is thus moved against the counting tooth 25 and against the arrest lever 45 by means of the trigger 1 as it is squeezed.

In this condition, when the hammer 6 has been armed, one obtains by squeezing the trigger 1, via the pull-rod 3, the displacement of the trip lever 5 for the disengagement of the hammer 6 and the firing of a first shot. By keeping the trigger 1 squeezed, one achieves a sequential fire action of a predetermined number of shots corresponding to the number of teeth or notches 42 in the rapid-fire control rod 26; the counting tooth 25 being operationally associated with the notches 42. In fact, the trigger 1 in the squeezed position continually maintains the trip lever 5 spaced from the hammer 6, so that, with the recoiling of the striker carriage 13 after the first shot, one obtains the engagement of the hammer 6 solely by the action of the rapid-fire lever 9. The recoiling of the striker carriage 13 determines furthermore, via the respective cam surface 15, a downward displacement of the intermediate transfer lever 15 and, therefore, of the disengager rocker lever arm 22, the counting tooth 25 of which, by engaging the first lower tooth of the group 42 moves the rapid-fire control rod 26 correspondingly downwardly. Concurrently, the trigger 1, the arming pull-rod 3 and the trip lever 5 do not move because the rapid-fire control rod 26 has, in this case, no influence at all on the arming pull rod 3, because of the slot 40. The subsequent movement (closing displacement) of the striker carriage 13 allows the upward return of the transfer lever 16, together with the disengager rocker lever arm 22, the counting tooth 25 of which engages the second tooth from the bottom in the group 42 of the rapid-fire control rod 26 while the rapid-fire rod 26 itself remains blocked in the position previously assumed by the arrest lever 45, the projection 44 of which becomes engaged with the first lower tooth of the group 43 as shown in FIG. 7. Such a displacement of the striker carriage 13 also determines, along with the respective cam surface 14, the displacement of the rapid-fire lever 9 for the disengagement of the hammer 6. One thus obtains the firing of a second shot which obviously is followed by a repeated sequence of the above described phases.

In fact, after the second shot, the recoiling striker carriage 13 moves the transfer lever 16 downwardly and, along with it, the disengager rocker lever arm 22, the counting tooth 25 which, acting on the second tooth of the group 42, determines a further downward displacement of the rapid-fire control rod 26.

When the striker carriage 13 returns to the closing position for the firing of a third shot, the transfer lever 16 and the disengager rocker lever arm 22 are displaced upwardly. Because of this movement, the counting tooth 25 of the disengager rocker lever arm 22 engages the third upper tooth of the group 42 of the rapid-fire control rod 26, while the rapid-fire control rod 26 remains blocked in its new position by the arrest lever 45.

The above sequence of movements is repeated shot after shot, automatically until the counting tooth 25 no longer engages a tooth in the group 42 of the rapid-fire control rod. At this point, the recoiling of the striker carriage 13, after the firing of the last pre-established shot, determines the downward displacement of the transfer lever 16 and of the disengager rocker lever arm 22 connected therewith, so as to downwardly displace the rapid-fire control rod 26. With this last displacement, however, the rapid-fire control rod 26 acts, with its portion located above the upper slot 40, upon the pin 39 of the arming pull-rod 3, so as to move the arming pull-rod 3 angularly and downwardly. As a result, arming pull-rod 3 frees the trip lever 5 which is displaced toward the hammer 6, engaging the hammer 6 in armed position, so that the subsequent disengagement of the hammer 6 can be achieved only by acting on the trigger 1. It is therefore, necessary to release the trigger 1 and interrupt the rapid-fire action after the firing of the predetermined number of shots.

The weapon is now ready for a repeated sequence of shots of the same predetermined length and this will occur until the disengager rocker lever arm 22 is moved into the inactive position by means of the first selector means 27, 28 and 29, and by the nullification of the action of the arrest lever 45. When this is done, the weapon may be employed in its traditional and conventional manner, i.e. single shot, semi-automatic firing or uncontrolled automatic firing.

I claim:

1. In an automatic weapon which includes a trigger; a hammer for angular displacements toward and away from a firing pin; a pair of arming teeth on the hammer and angularly spaced from each other; a trip lever associated with one of the arming teeth on the hammer and capable of angular displacements; an arming pull-rod attached to the trigger and acting on the trip lever for disengaging the hammer; a rapid-fire lever associated with the other arming tooth on the hammer during rapid-firing; and a striker carriage having first and second cam surfaces engaging the lever and the arming pull-rod during the recoiling and closing movements of the carriage striker, improved means for controlling rapid-fire conmprising:

(a) a transfer lever for transferring the movement of the striker carriage to the arming pull-rod for angularly displacing the arming pull-rod to engage and disengage the trip lever of the hammer;

(b) fire selector means for controlled rapid-fire action, said fire selector means being angularly displaceable;

(c) a disengager rocker lever arm pivotably associated with said transfer lever and movable into active and inactive positions with said first selector means;

(d) a counting tooth integral with said disengager rocker lever arm for counting the sequentially fired shots;

(e) a rapid-fire control rod attached to the arming pull-rod and guided for vertical, linear movements by action of said disengager rocker lever arm, and for angular movements as a result of the displacements of the arming pull rod;

(f) a first group of teeth in said rapid-fire control rod engaging said counting tooth; and (g) a second group of teeth in said rapid-fire control rod associated with an arrest lever associated with said rapid-fire control rod, the number of teeth in said second group corresponding to the number of shots to be fired sequentially.

2. The improvement according to claim 1, wherein said transfer lever is pivoted on the same pin as the hammer and extends over the arming pull-rod; said transfer lever being urged by a spring to remain near the striker carriage and having on its upper surrace a cam follower associated with a cam surface provided on the striker carriage to determine the angular displacements of the transfer lever in opposition to said spring.

3. The improvement according to claim 1, wherein to said transfer lever there is associated a small mobile rod for engaging a projection integral with the arming pull-rod for angularly displacing the arming pull-rod when said disengager rocker lever arm is in the inactive position, said mobile rod being pivoted and displaceable with said disengager rocker lever arm.

4. The improvement according to claim 1, wherein said disengager rocker lever arm is pivoted on said transfer lever so as to move either together or independently thereof, said disengager rocker lever arm being urged by a spring which keeps it normally displaced toward the rapid-fire control rod in the active position in opposition to the action of said fire-selector means.

5. The improvement according to claim 1, wherein said fire selector means comprises:

(a) a shaft concentric with the pivot axis of the hammer;

(b) a lever attached to one extremity of said shaft; and (c) a cam plate attached to the other extremity of said shaft to act against the disengager rocker lever arm and arrest it in the inactive position; said lever engaging spring means for permitting the arrest thereof in two different positions which correspond the activation and the inactivation of said disengager.

6. The improvement according to claim 1, wherein said rapid fire control rod is mounted on a support plate removably attached to the handle of the weapon.

7. The improvement according to claim 6, wherein said rapid-fire control rod is coupled by means of a first slot to a pin integral with said support plate and is attached by means of a second slot to a pin integral with the arming pull-rod, said rapid-fire control rod being urged by a base spring which keeps it normally displaced upwardly in opposition to the action of said counting tooth, said second slot determining, with said pin, an angular displacement of the arming pull-rod at the termination of the sequence of controlled automatic fire.

8. The means according to claim 1, wherein said arrest lever of said rapid-fire control rod is associated with means for inactivating said transfer lever.

* * * * *